United States Patent [19]

Garza

[11] Patent Number: 4,938,124

[45] Date of Patent: Jul. 3, 1990

[54] SUBSTRUCTURE RADON GAS EVACUATION SYSTEM

[76] Inventor: Roberto M. Garza, P.O. Box 7036, San Antonio, Tex. 78207

[21] Appl. No.: 341,416

[22] Filed: Apr. 21, 1989

[51] Int. Cl.[5] ..... F24F 11/00

[52] U.S. Cl. ..... 98/42.04; 98/42.01; 98/42.06; 98/70

[58] Field of Search ..... 98/1.5, 42.01, 42.02, 98/42.04, 42.06, 42.12, 42.16, 42.19, 68, 70, 115.1, 115.3

[56] References Cited

U.S. PATENT DOCUMENTS

| | | | |
|---|---|---|---|
| 1,292,832 | 1/1919 | McDonald | 98/70 |
| 2,171,883 | 9/1939 | McDerment | 98/68 |
| 4,371,383 | 2/1983 | Rost | 55/169 |
| 4,387,629 | 6/1983 | Bolton | 98/70 |
| 4,492,151 | 1/1985 | Mattei | 98/1.5 X |
| 4,578,912 | 4/1986 | Ericsson | 52/169.5 |
| 4,719,848 | 1/1988 | Bergeron | 98/31 |
| 4,773,309 | 9/1988 | Walters | 98/31.6 |
| 4,858,521 | 8/1989 | Heh | 98/42.06 X |

OTHER PUBLICATIONS

"Radon Reduction Techniques for Detached Houses", *Technical Guidance*, EPA/625/5-86/019, U.S. Environmental Protection Agency, Jun. 1986.

*Primary Examiner*—Harold Joyce
*Attorney, Agent, or Firm*—Gunn, Lee & Miller

[57] ABSTRACT

A network of conduits are arranged under the foundation of the house. A vent pipe extends from the network conduits to above the house. A slight vacuum is drawn on the network of conduits so that any gases that may exist below the house are drawn into the conduits and discharged into the atmosphere. One of the gases being discharged into the atmosphere is radon. A manual and automatic system is provided for maintaining the vacuum pressure on the network.

7 Claims, 3 Drawing Sheets

SUBSTRUCTURE RADON GAS EVACUATION SYSTEM

FIELD OF THE INVENTION

The present invention relates generally to air exhaust and ventilation systems for structures such as homes and more particularly to a ventilation system designed to remove harmful gases, such as radon, from beneath structures, such as homes, and disperse them into the atmosphere.

GENERAL BACKGROUND AND DESCRIPTION OF THE PRIOR ART

The present of accumulations of radioactive radon gas in homes and similar structures has in recent years become the focus of a great deal of attention. The gradual release of radon gas into the atmosphere from the soil is nothing new, but the problem has become acute because of increased efforts to make structural dwellings more thermally secure and thus more likely to accumulate harmful gases.

Radon is produced by the gradual decay of solid radioactive elements in the soil. While geographic regions that contain large concentrations of solid radioactive elements in the soil will likewise release larger amounts of radon into the atmosphere, it is not the mere release, even in such areas, that is of concern. The uninterrupted movement of radon into the atmosphere is generally at such a slow rate that little or no health hazard is posed by the release alone.

The concern that has arisen in recent years began with the discovery of large concentrations of radon gas that had accumulated in dwellings and similar structures. It soon became apparent that it was not the rate at which radon gas was given off by the soil, but the failure of dwellings to allow radon and other contaminants to continue on into the atmosphere. In an effort to make homes more energy efficient, builders have attempted to physically and thermally seal the structures as tight as possible. While this did indeed succeed in reducing thermal losses into the atmosphere, it also succeeded in retaining and accumulating contaminated air.

One factor in the degree of contaminant accumulation is the structure of the building itself and more specifically the structure of the support system in contact with the ground. In recent years, more and more homes are being built upon what is called a slab foundation. The effect of this type of foundation is to act as a cap to contain gases from the soil, allowing them to escape only when they find their way up into the house by way of cracks and intentionally placed holes in the foundation. Because modern air circulation systems will typically only recycle internal air rather than exchange it with external air, these contaminants tend to remain and accumulate within the house.

One solution to the problem that a number of existing or proposed systems utilized is the controlled exchange of inside contaminated air with fresh outside air. While this method does reduce the level of radon and other contaminants within the structure, it also tends to sacrifice the thermal integrity of the house. In addition, because these contaminant removal systems rely on the home's air circulation system, they are effective only when such system is in operation.

Those few proposed systems that avoid the exchange of interior air generally contain forced vacuum components that dramatically increase both the installation and operational costs. It would therefore be desirable and advantageous to devise a ventilation/evacuation system that would prevent the accumulation of radon gas within homes or similar structures without effecting the thermal efficiency of the home, and without incurring large installation, maintenance, and operational costs.

SUMMARY OF THE INVENTION

Accordingly, the primary object of the present invention is to provide a substructure radon gas ventilation and exhaust system that will reduce the accumulation within a house or similar structure of harmful gases from the soil.

A second object of the invention is to provide such a ventilation and exhaust system that does not interact with the building's internal air circulation system and thus will not effect the thermal efficiency of the structure.

A third object of the invention is to provide such a system that is essentially passive and which would require low maintenance and incur low installation and operational costs.

The foregoing objects are achieved in a ventilation-/evacuation system made up of a network of perforated PVC pipe which is placed below the foundation of a building and which is vented by a vertical section of pipe to a position above the roof of the building. A vacuum is created on the pipe network by way of a wind vane/vent resting atop the vertical pipe. The network of PVC pipe below the foundation is placed within a bed of porous aggregate to facilitate gas absorption. A vacuum indicating instrument allows monitoring of the system's operation.

BRIEF DESCRIPTION OF THE DRAWINGS

The novel features believed characteristic of the invention are set forth in the appended claims. The invention itself, however, as well as a preferred mode of use, further objects and advantages thereof, will be best understood by reference to the following detailed description of illustrative embodiments when read in conjunction with the accompanying drawings, wherein:

DESCRIPTION OF THE PREFERRED EMBODIMENT

Figure 1:
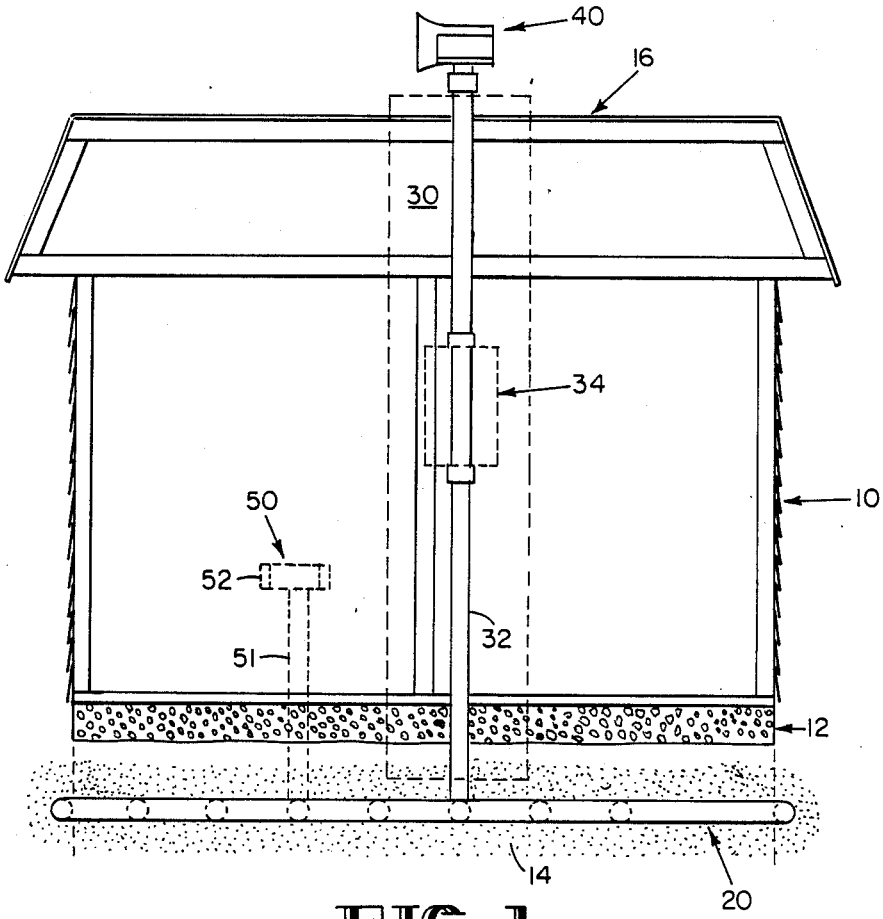
FIG. 1 is a side elevational view of a typical installation of the gas evacuation system in a simplified structure.

As shown in FIG. 1, a house or similar enclosed building 10 is constructed upon a concrete slab 12. House 10 may be any shape or size, although it is assumed that house 10 will be capable of being completely enclosed such as by closing all windows and doors. The ground under house 10 is gas permeable, and in the preferred embodiment is a layer of crushed rock, gravel, or some other similar gas-permeable aggregate 14.

As shown in FIG. 1, the invention consists of three basic parts: a gas receiving network 20, a conduit means 30, and a venting means 40. An optional feature is a vacuum indicator means 50.

Figure 2:
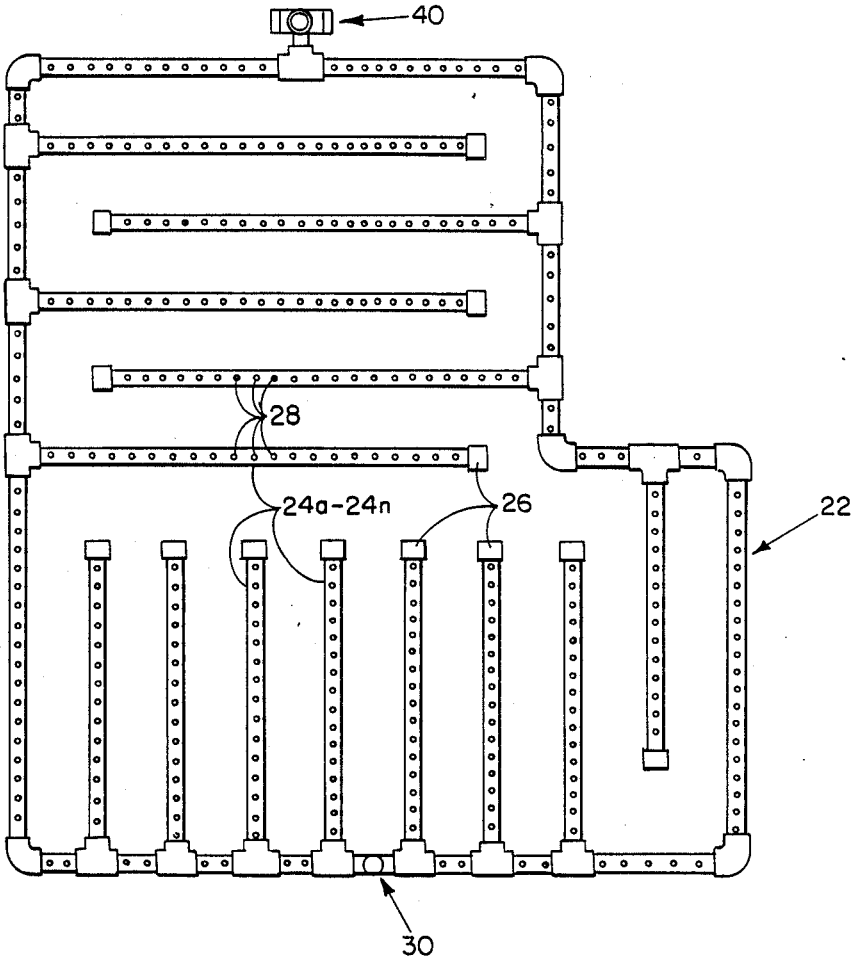
FIG. 2 is a bottom plan view of the gas gathering elements of the evacuation system.

Gas receiving network 20 is shown in side view in FIG. 1 and in bottom plan view in FIG. 2. Gas receiving network 20 is located below slab 12, at a depth sufficient so as to be beneath typical plumbing and electrical wiring. The receiving network 20 is arranged in a pattern so as to efficiently draw air from all areas beneath the house 10. In the preferred embodiment, gas receiving network 20 comprises at least one loop pipe 22, whose shape generally conforms to the perimeter of slab 12, and a number of feeder pipes 24a–24n, which extend inward from loop pipe 22 to cover all areas under house 10. In the preferred embodiment, all pipes are approximately four inches in diameter.

Figure 1A:
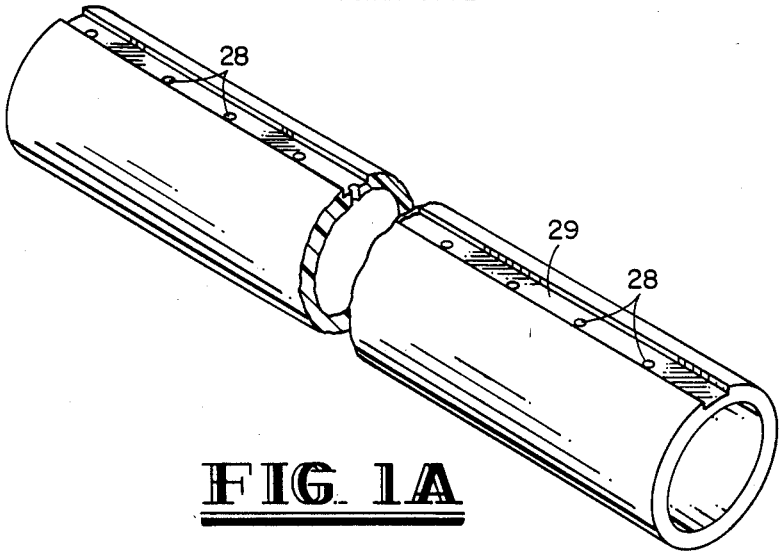
FIG. 1A is a detailed perspective view of a section of the gathering system pipe.

Each feeder pipe 24a–24n is in communication with loop pipe 22, which may be accomplished by attaching one end to loop pipe 22. On the opposing end of each feeder pipe 24a–24n is a cap 26. Loop pipe 22 and feeder pipes 24a–24n are perforated with holes 28, which permit the surrounding air to be drawn into the gas receiving network 20. In the preferred embodiment all holes 28 face down away from the house 10 above gas receiving network 20. Each feeder pipe 24a–24n is thereby sealed, except for its connection to loop pipe 22 and holes 28. As explained below, when the invention is in operation, air is drawn by vacuum pressure into holes 28, into each feeder pipe 24a–24n, then into loop pipe 22, and then eventually into conduit means 30. FIG. 1A shows in more detail a section of receiving network 20, indicating evenly spaced holes 28 and groove 29 designed to gather in gases present in the permeable aggregate 14 beneath the house 10.

Conduit means 30 delivers gas, which may contain radon, to the outside of house 10 and rises vertically from gas receiving network 20. In the preferred embodiment, conduit means 30 comprises an exhaust conduit 32, which directly connects the receiving network 20 to venting means 40. Exhaust conduit 32 may be made from any hollow material, preferably PVC pipe. Exhaust conduit 32 may be routed through a filter cabinet 34. In the preferred embodiment, filter cabinet 34 is mounted mid-way on conduit means 32 and is designed to accommodate any filter capable of removing radon from the exhaust air flow. The filter may be necessary in some areas as determined by the Environmental Protection Agency.

FIGS. 1 and 2 also show vacuum indicator means 50 inside house 10. The function of vacuum indicator means 50 is to verify the existence of a vacuum pressure within the receiving network 20. Vacuum indicator means 50 may be installed at a height and location, either within house 10 or just outside the walls of house 10, such that it might be conveniently monitored. Vacuum indicator means 50 is a closed extension of receiving network 20 and will contain whatever vacuum pressure is present in receiving network 20.

In the preferred embodiment, vacuum indicator means 50 comprises a standpipe 51 and instrumentation 52. Instrumentation 52 is in direct communication with gas receiving network 20 by means of standpipe 51, which rises vertically from gas receiving network 20.

Figure 3A:
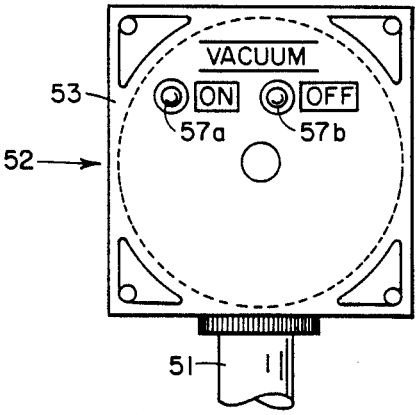
FIG. 3*a* is a front elevational view of the vacuum indicator means shown in FIG. 1.
Figure 3B:
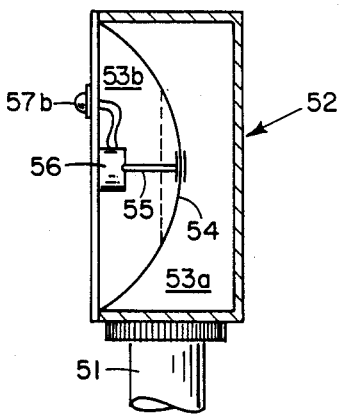
FIG. 3*b* is a side elevational view of the vacuum indicator means shown in FIG. 1.

FIGS. 3a and 3b show instrumentation 52 in further detail. Generally, instrumentation 52 comprises a means for measuring air pressure inside gas receiving network 20 and for indicating such pressure to the operator. Instrumentation 52 is comprised of a housing 53, mounted to standpipe 51. An elastic diaphragm 54 inside housing 53 separates housing 53 into two compartments. A rear compartment 53a is in direct communication with standpipe 51. Except for being in communication with standpipe 51, rear housing 53a is sealed such that it is air tight. A front compartment 53b is sealed from rear compartment 53a. Diaphragm 54 is freely moveable from an unstretched position into rear compartment 53a.

A translator shaft 55, having a first and a second end, is centrally attached at one end to diaphragm 54, extending orthogonally therefrom. The second end of shaft 55 is attached to switch 56, also located within housing 53. Switch 56 responds to the movement of shaft 55. Switch 56 operates two on-off indicator lights 57a and 57b, also mounted inside housing 53.

When the invention is in operation, and a negative air pressure exists in receiving network 20, the pressure is transmitted to rear compartment 53a, which causes diaphragm 54 to expand into rear compartment 53a. This moves shaft 55 so as to trip switch 56. Switch 56 turns on light 57a, which is typically green, to indicate that a negative air pressure exists. When no negative air pressure exists in receiving network 20, indicating that the system is not functioning, no negative air pressure will exist in rear compartment 53a and diaphragm 54 will return to its unstretched position. In doing so, shaft 55 will trip switch 56 so as to turn off light 57a and turn on light 57b, which is typically red.

Referring again to FIG. 1, venting means 40 is mounted outside house 10. Venting means 40 may be entirely motorized, but, venting means 40 may also be wind operated. As explained below, the preferred embodiment alternatively uses both methods, depending on the present velocity of the wind. Accordingly, venting means 40 is mounted on roof 16 of house 10 for best exposure to the wind.

Figure 4A:
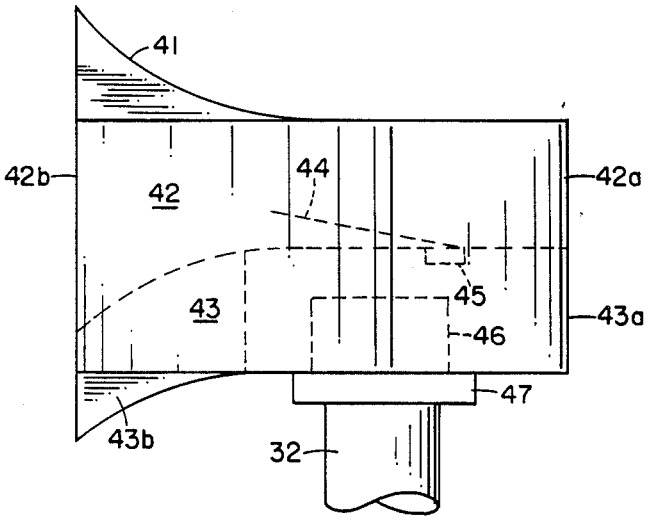
FIG. 4*a* is a front elevational view of the venting means shown in FIG. 1.
Figure 4B:
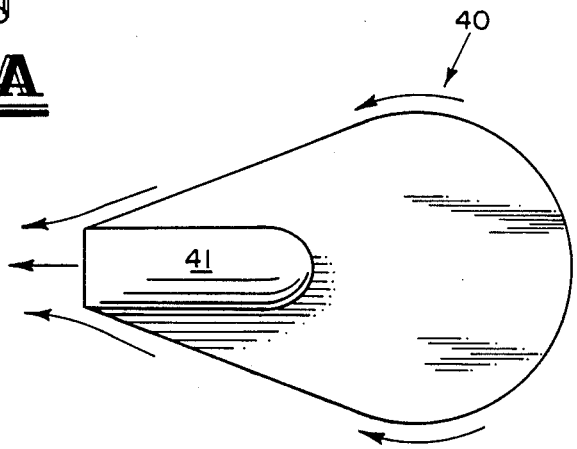
FIG. 4*b* is a top plan view of the venting means shown in FIG. 1.

FIGS. 4a and 4b show venting means 40 in further detail. FIG. 4a is a side elevational view and FIG. 4b is a top plan, which shows the flow of wind around venting means 40. Venting means 40 generally comprises three parts: a wind vane 41, a wind channel 42, and a blower channel 43. The bottom of venting means 40 is mounted via a swivel bearing 47 to exhaust conduit 32.

Wind vane 41 is at the top of venting means 40 and responds to wind, causing venting means 40 to rotate on bearing 47. In the preferred embodiment, wind vane 41 is simply an extension of the top outer portion of vacuum channel 42, shaped to respond to wind direction.

In the preferred embodiment, vacuum channel 42 and blower channel 43 are contained within a single housing with vacuum channel 42 located above blower channel 43. A flap means 44 is transposed between vacuum channel 42 and blower channel 43 and covers an opening between vacuum channel 42 and blower channel 43. Flap 44 is attached to one edge of the opening so that flap 44 may open into vacuum channel 42. A switch 45 operates in response to movement of flap 44.

The front of vacuum channel 42 is aerodynamically shaped to direct wind around its front, or lead end 42a and maximize air velocity flowing past its sides. The rear, or trailing end 42*b*, of vacuum channel is narrow, relative to the front and is open to the atmosphere, and is an outtake for exhaust conduit 32. In general, vacuum channel 42 is a teardrop shape and may be considered to be a type of airfoil body. When the wind is blowing, wind vane 41 causes venting means 40 to turn in a direction parallel to the wind, such that the front of venting 40 is facing the direction in which the wind is blowing. Wind will then flow around venting means 40 creating a low pressure area behind venting means 40. When the air velocity around venting means 40 becomes sufficient, this low pressure causes flap 44 to lift, drawing air from exhaust conduit 32 into vacuum channel 42 and out into the atmosphere. The opening of flap means 44 by wind directed around venting means 40 is an application of a physical phenomenon known as the Venturi effect.

Blower channel 43 is in direct communication with exhaust conduit 32. Blower channel 43 contains a motorized blower 46, which will draw air out of exhaust conduit 32 and direct the air flow in a direction generally longitudinal to blower channel 43. When the wind velocity in channel 43 is insufficient to open flap 44, flap 44 rests against switch 45, thereby turning on switch, causing motorized blower 46 to operate.

Blower channel 43 is shaped so that when air is being drawn through flap 44, a minimum flow of air will escape through blower channel 43. In the preferred embodiment, this is accomplished by directing the open end 43*b* of blower channel 43 downward. Other configurations of blower channel 43 may be used to accomplish the same purpose.

As discussed above, in the preferred embodiment vacuum channel 42 and blower channel 43 are contained within a single housing. Thus, the entire housing will be designed with the aerodynamic features discussed above in connection with vacuum channel 42.

Figure 4C:
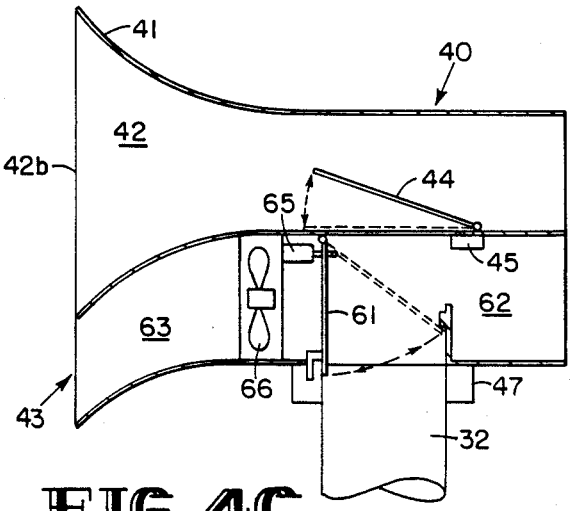
FIG. 4*c* is a side elevational view of an alternative embodiment of the venting means shown in FIG. 1.

An alternative embodiment of venting means 40 is shown in FIG. 4*c*. In this embodiment, blower channel 43 contains a means for ensuring that when the wind is blowing and would otherwise open flap 44, the flow of air through blower channel 43 before reaching flap means 44 does not cause flap means 44 to close. Accordingly, blower channel 43 contains an air valve 61, which divides blower channel 43 into two parts: a blower intake compartment 62 and a blower outlet 63. Air valve 61 is opened and shut by means of a solenoid 65. In its open position, air valve 61 closes blower channel 43 from vacuum channel 42 and opens outlet 63 to exhaust conduit 32. In its closed position, air valve 61 closes outlet 63 and permits air to flow from conduit 32 through flap 44.

When the air flow in wind channel 42 is not sufficient to create sufficient low pressure above flap 44 to open flap 44, flap 44 drops to its horizontal position. This triggers switch 45 which causes solenoid 65 to move air valve 61 to its open position. At the same time, switch 45 also turns on blower 66, which draws air from exhaust conduit 32, thus sustaining the negative air pressure in receiving network 20. The exhaust air is forced out through blower outlet 63 and into the atmosphere. When the air flow in wind channel is sufficient to open flap 44, switch 45 turns off blower 66 and returns solenoid 65 to a position that pulls air valve 61 into its closed position. Blower 66 receives power through slip rings and brushes (not shown) as are old in the art.

Although the invention has been described with reference to specific embodiments, this description is not meant to be construed in a limiting sense. Various modifications of the disclosed embodiment, as well as alternative embodiments of the invention, will become apparent to persons skilled in the art upon reference to the description of the invention. It is therefore contemplated that the appended claims will cover such modifications that fall within the true scope of the invention.

I claim:

1. A substructure gas ventilation system for a house or a similar habitable structure having substructure gas under the structure comprising:

a network of flow connected/perforated pipe under said structure;

a vertical pipe in flow connection with and rising from said network, said vertical pipe acting as a vent for said network;

first and second vacuum means for creating a negative air pressure in said vertical pipe, said negative air pressure being transmitted to said network to draw said substructure gas therethrough, said first vacuum means being a blower means in flow communication with said vertical pipe, and said second vacuum means being a Venturi structure exposed to wind, said Venturi structure being conductive of said wind therethrough, said Venturi structure further being in flow communication with said vertical pipe, said Venturi structure, when conductive of said wind, creating said negative air pressure in said vertical pipe; and an air valve between said blower means and said Venturi structure, said air valve alternately connecting said vertical pipe to said blower means or to said Venturi structure, such that if said wind is not present through said Venturi structure to create said negative air pressure, said blower means will create said negative air pressure.

2. A substructure gas ventilation system for a house or a similar habitable structure, comprising:

a network of flow connected/perforated pipe under said structure;

a vertical pipe in flow connection with and rising from said network, said vertical pipe acting as a vent for said network;

vacuum means for creating a negative air pressure in said vertical pipe, said negative air pressure being transmitted to said network to draw said substructure gas therethrough, wherein said vacuum means for creating said negative air pressure comprises a housing for exposure to wind having a vacuum channel and a blower means in a blower channel, a flap between said vacuum channel and said blower channel permitting communication between said vacuum channel and said blower channel, said housing having means for rotation according to the direction of said wind and being aerodynamically shaped to create a low pressure area at a trailing end of said housing when said wind is flowing, said trailing end being open to atmosphere, said vacuum channel being in flow communication with said trailing end, said low pressure area at said trailing end creating said negative air pressure in said vacuum channel and in said vertical pipe when said wind is flowing, and said blower means creating said negative air pressure in said blower channel and in said vertical pipe when said wind is not flowing.

3. The substructure ventilation system of claim 2 wherein said flap operates an electrical switch which controls a valve to prevent creation of said negative air pressure by said blower means in said blower channel when said low pressure area is created at said trailing end of said housing by said wind.

4. The substructure ventilation system of claim 2 includes monitoring means with an indicator light to indicate whether said low pressure area is created at said trailing end of said housing, said monitoring means being in flow communication with said network.

5. A substructure gas ventilation system for a house or a similar habitable structure having substructure gas under the structure comprising:

a network of flow connected/perforated pipe with a peripheral loop pipe manifold and a grid of interior feeder pipes under said structure;

a vertical pipe in flow connection with and rising from said network, said vertical pipe having an open upper end and acting as a vent for said network;

first and second vacuum means for creating a negative air pressure in said vertical pipe, said negative air pressure being transmitted to said network to draw said substructure gas therethrough, said first vacuum means being a passive vacuum means exposed to wind, and said second vacuum means being an actively powered means; and an air valve between said passive vacuum means and said actively powered vacuum means, said air valve alternately connecting said vertical pipe to said passive vacuum means or to said actively powered vacuum means, such that if said wind is not present to create said negative air pressure by way of said passive vacuum means, said actively powered vacuum means will create said negative air pressure.

6. A substructure gas ventilation system for a house or a similar habitable structure comprising:

a network of flow connected/perforated pipe with a peripheral loop pipe manifold and a grid of interior feeder pipes under said structure;

a vertical pipe in flow connection with and rising from said network, said vertical pipe having an open upper end and acting as a vent for said network;

a housing mounted on said open upper end of said vertical pipe for exposure to wind, said housing having a vacuum channel and a blower means in a blower channel, said housing having means for rotation according to the direction of said wind and being aerodynamically shaped to create a low pressure area at a trailing end of said housing when said wind is flowing, said trailing end being open to atmosphere, and said vacuum channel and said blower channel being in flow communication with said trailing end, said vacuum channel and said blower channel further being in flow communication with said vertical pipe, said low pressure area at said trailing end creating a negative air pressure in said vacuum channel and in said vertical pipe when said wind is flowing, said blower means creating a negative air pressure in said blower channel and in said vertical pipe when said wind is not flowing, said negative air pressure being transmitted to said network to draw said substructure gas therethrough; and a flap between said vacuum channel and said blower channel permitting communication between said vacuum channel and said blower channel when said wind is flowing and preventing communication between said vacuum channel and said blower channel when said wind is not flowing.

7. The substructure gas ventilation system of claim 6 wherein said flap operates an electrical switch which controls an air valve to prevent creation of said negative air pressure in said blower channel when said low pressure area is created at said trailing end of said housing by said wind.

* * * * *